United States Patent [19]

Aoyama et al.

[11] 4,073,202

[45] Feb. 14, 1978

[54] SYSTEM TO FEED EXHAUST GAS INTO THE INTAKE MANIFOLD

[75] Inventors: Syunichi Aoyama, Yokohama; Yasuo Nakajima, Yokosuka, both of Japan

[73] Assignee: Nissan Motor Company, Limited, Japan

[21] Appl. No.: 678,433

[22] Filed: Apr. 19, 1976

[30] Foreign Application Priority Data

May 19, 1975 Japan ..... 50-60023

[51] Int. Cl.[2] ..... F02B 33/00; F02M 25/06; F02D 13/00

[52] U.S. Cl. ..... 74/860; 74/856; 123/119 A

[58] Field of Search ..... 123/119 A; 74/860, 859, 74/856

[56] References Cited

U.S. PATENT DOCUMENTS

| | | | |
|---|---|---|---|
| 3,584,521 | 6/1971 | Tooker et al. | 74/856 |
| 3,641,989 | 2/1972 | Hill | 123/119 A |
| 3,783,847 | 1/1974 | Kolody | 123/119 A |
| 3,915,035 | 10/1975 | Chana | 123/119 A |
| 3,978,834 | 9/1976 | Arnaud et al. | 123/119 A |
| 3,981,283 | 9/1976 | Kaufman | 123/119 A |

*Primary Examiner*—Wendell E. Burns
*Attorney, Agent, or Firm*—Lowe, King, Price & Markva

[57] ABSTRACT

A restrictor in an exhaust gas feed conduit to the intake manifold has therein an opening operable to allow the exhaust gases passing through the opening to have a sonic velocity. A valve operates in response to the flow rate of the intake air passing through the carburetor for proportionally controlling the flow rate of the feeding exhaust gases with that of the intake air. The flow rate communicated to the valve has an atmospheric bleed controlled by a solenoid valve energized by a transmission switch.

4 Claims, 3 Drawing Figures

SYSTEM TO FEED EXHAUST GAS INTO THE INTAKE MANIFOLD

The present invention relates in general to an exhaust gas purifying system of an internal combustion engine, and more particularly to an exhaust gas feed system into the intake for effectively reducing the amount of nitrogen oxides contained in the exhaust gases issued from the engine.

As well known in the art, the nitrogen oxides contained in the exhaust gases emitted from the internal combustion engine belong to a group of compounds which is greatly difficult to avoid from forming in the exhaust gases. One of the procedures for reducing formation of such harmful nitrogen oxides in the exhaust gases is a so called "exhaust gas feed system" in which a portion of the exhaust gases is fed, during the engine operation, into the combustion chambers of the engine via an intake manifold. With this procedure, the combustion temperature and the combustion pressure of an air-fuel mixture in each of the combustion chambers are reduced to prevent the creation of the nitrogen oxides.

Apart from this, a conventional exhaust gas feed system has therein an exhaust gas flow control valve which is operable to proportionally control the opening degree thereof in response to the flow rate of intake air. In this conventional system, however, the actual flow rate of the exhaust gases passing through the system is caused to vary with the discrepancies in the pressure between the intake manifold and the exhaust manifold even when the opening degree of the valve is kept constant. Therefore, if the engine is kept in a low load condition wherein the pressure gap between the two manifolds is largest, excessively large amounts of exhaust gases are caused to feed into the intake manifold with a result of depreciating the characteristic performance and the fuel economy of the engine.

Therefore, the present invention contemplates provision of a new and improved exhaust gas feed system which can obviate the drawbacks and demerits encountered in the prior art system as mentioned above.

It is an object of the present invention to provide an exhaust gas feed system which can proportionally and accurately control the flow rate of the exhaust gases to the intake manifold in dependence on the flow rate of intake air passing through a carburettor or air-fuel mixture supply means.

It is another object of the present invention to provide an exhaust gas feed system which comprises a gas flow controller having an opening capable of allowing the gases passed through the opening to have a sonic velocity.

It is another object of the present invention to provide an exhaust gas feed system which has a valve with a tapered valve head insertable into an opening for varying the feed rate of the exhaust gases into the intake manifold.

It is still another object of the present invention to provide an exhaust gas feed system which comprises a valve operating member having a diaphragm chamber fluidly connected to a port positioned just above the throttle valve, but below the venturi, of the carburettor.

It is a further object of the present invention to provide an exhaust gas feed system which has a controller actuator comprising a magnetic valve operable to open the interior of the diaphragm chamber into the atmosphere when deenergized.

It is a still further object of the present invention to provide a system in which the operation of a magnetic valve of a controller actuator is controlled by a transmission switch, the switch being capable of closing its circuit when a transmission is within its low and middle speed ranges.

It is a further object of the present invention to provide a system which can be employed in an internal combustion engine having combustion chambers each of which is equipped with a plurality of ignition plugs in order to effectively reduce the amount of nitrogen oxides emitted from the engine.

It is a further object of the present invention to provide an exhaust gas feed system which is simple in construction and economical.

Other objects and advantages of the present invention will be more apparent from the following detailed description when taken in conjunction with the accompanying drawings, in which.

Prior to describing the construction of the system of the present invention, detailed explanation of the prior art system will be made in order to make more clear the inventive steps of the present invention.

Figure 1:
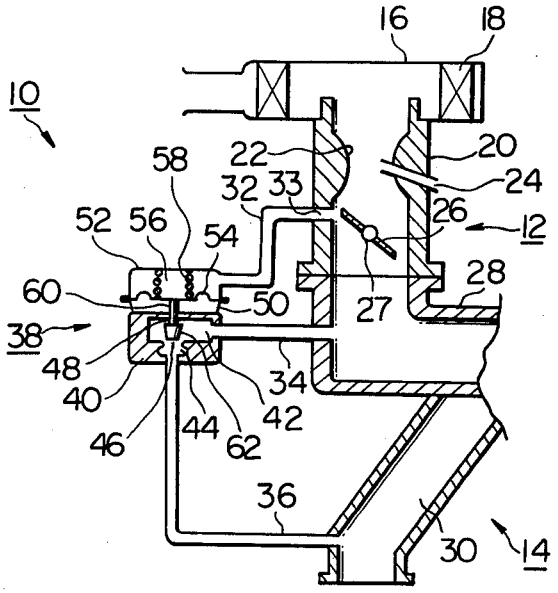
FIG. 1 is a sketch of a prior art exhaust gas feed system installed on an internal combustion engine.

FIG. 1 shows the conventional exhaust gas feed system 10 with an intake system 12 and an exhaust system 14 of an internal combustion engine (not shown).

The intake system 12 generally comprises an air filter 16 containing therein a filter element 18, a carburettor 20 provided with a venturi portion 22, a fuel nozzle 24 and a throttle valve 26, and an intake manifold 28, while the exhaust system 14 comprises an exhaust manifold 30 connected at the upstream portion to the engine.

The system 10 generally comprises a first tube 32, a second tube 34, a third tube 36 and a gas flow controller 38 to which one end of each tube 32, 34 and 36 is fluidly connected, the other ends of these tubes being respectively connected to a port 33 between the venturi and the throttle valve of the carburettor 20, the intake manifold 28 and the exhaust manifold 30, as shown.

The gas flow controller 38 includes a casing 40 having therein first and second chambers 42 and 44 which are separated by a partition portion (no numeral) with an opening 46 forming a valve seat and are respectively connected with the second and third tubes 34 and 36, as shown. The casing 40 is further formed at the upper portion thereof with an opening 48 communicating with the first chamber 42.

Connected to the upper portion of the casing 40 through a support member 50 is a vacuum actuator 52 which has a diaphragm member 54 to define a vacuum chamber 56 therein. The vacuum chamber 56 is connected to the first tube 32 and contains therein a compression spring 58 to biase the diaphragm member 54 downwardly of the drawing. A valve stem 60 having at one end thereof a tapered valve head 62 is connected at the other end thereof to the diaphragm member so as to seat the head 62 in the opening 46. The opening 48 is so formed to sealingly surround the valve stem 60.

Referring back to the first tube 32, the port 33 is shown located in a position just above the throttle valve 26, and more particularly, in a place where the port 33 is positioned in the intake manifold side when the throttle valve 26 is rotated a predetermined angle from its closing position. This is because of a fact that the above-mentioned position of the port 33 is optimum to obtain, under normal operation of the engine, a considerable degree of vacuum which is proportional to the flow rate of the intake air passing through the carburettor 12. Thus, the upward and downward movements of the diaphragm member 54 are proportional to the flow rate of the intake air with a result that the tapered valve head 62 is caused to proportionally vary the opening degree of the opening 46 in accordance with the flow rate of the intake air.

It is however to be noted that, in this prior art system, the actual flow rate of the exhaust gases passing through the system 10 varies with discrepancies in the pressure between the intake manifold 28 and the exhaust manifold 30 even when the opening degree of the opening 46 is kept constant. This phenomenon will decrease the characteristic performance and fuel economy of the engine as mentioned hereinbefore.

Therefore, the most important object of the present invention is to provide a new and improved exhaust gas feed system which can completely obviate such drawback of the above-mentioned prior art system.

Figure 2:
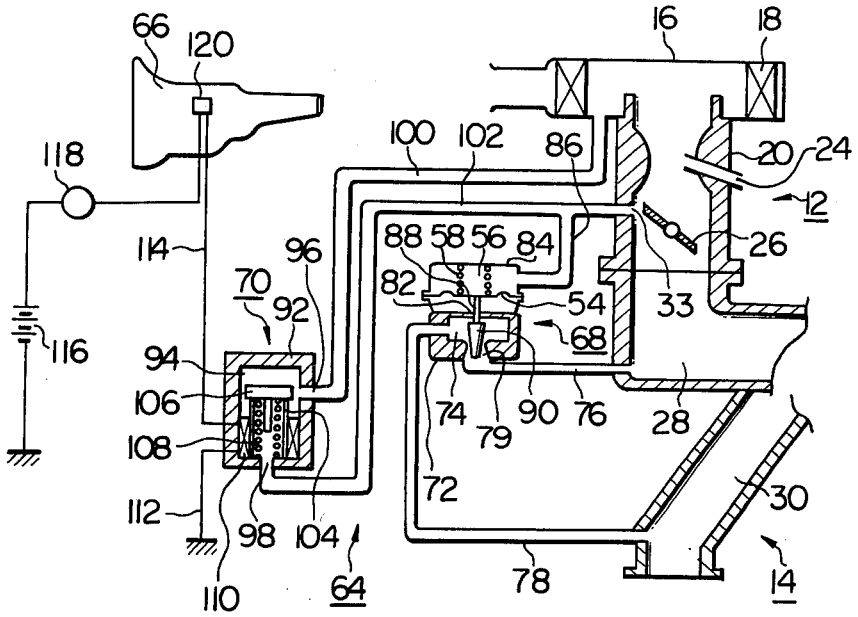
FIG. 2 is a sketch of an exhaust gas feed system according to the present invention, the system being illustrated with a transmission of an internal combustion engine.

Referring now to FIG. 2, there is shown an exhaust gas feed system 64 according to the present invention, the system 64 being illustrated with an intake system 12, an exhaust system 14 and a transmission 66.

In order to simplify the description, the explanation of the parts carrying the same reference numerals as in FIG. 1 will be omitted from the following description.

The exhaust gas recirculating system 64 of the present invention generally comprises a gas flow controller 68 and a controller actuator 70.

Figure 3:
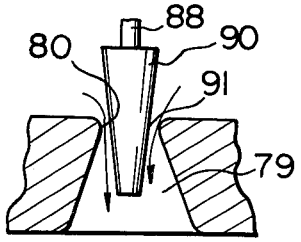
FIG. 3 is an enlarged sectional view of a valve employed in the system shown in FIG. 2.

The gas flow controller 68 includes a casing 72 having therein a chamber 74 communicating with the intake manifold 28 and the exhaust manifold 30 through tubes 76 and 78 forming a first conduit, respectively. As well shown in FIG. 3, a through hole 79 communicating with the tubes 76 and 78 is shaped to have a throat portion 80 for allowing the exhaust gases passing therethrough to have a sonic velocity. The casing 72 further has an opening 82 at the upper portion thereof. Connected to the upper portion of the casing 72 is a vacuum actuator 84 which is of a generally same construction as in FIG. 1. The vacuum chamber 56 communicates with the air-fuel mixture passage of the carburettor 20 (or the air-fuel mixture supply means) through a tube 86 and through the port 33. By the same reason as in the conventional system mentioned before, the port 33 is located in a position just above the throttle valve 26 of the carburettor 20. A valve stem 88 having at one end thereof an elongate tapered valve head 90 is connected, after passing through the opening 82, at the other end to the diaphragm member 54 in such a manner that the valve head 90 can seat on the throat portion 80 when the diaphragm member 54 takes its normal position. It is now to be noted that the degree of a clearance 91 defined between the valve head 90 and the throat portion 80 is proportionally varied in accordance with the upward and downward movements of the valve head 90, as well seen from FIG. 3.

The controller actuator 70 is a so-called magnetic valve which comprises a casing 92 having a chamber 94, a first opening 96, and a second opening 98. The first and second openings are fluidly connected to the clean air side of the air filter 16 and the tube 86 through respective tubes 100 and 102. Within the chamber 94 is disposed a cylindrical member 104 acting as a valve seat, which member 104 is arranged to surround the opening 98. A valve member 106 having a flat valve head portion is movably disposed in the chamber 94 so as to allow the valve head portion to sealingly contact the top end of the cylindrical member 104. The valve member 106 is made of magnetic material and is biased by a compression spring 108 toward its open state. Surrounding the cylindrical member 104 is a solenoid coil 110 which has one end 112 grounded and the other end 114 connected to a battery 116 through an ignition switch 118 and through a transmission switch 120. The transmission switch 120 is arranged to close its circuit only when the transmission 66 is in its low and middle speed ranges.

With the above-stated construction of the exhaust gas feed system of the present invention, the operation is as follows:

Under the engine operation, when the transmission 66 is in the low or middle speed range to cause the transmission switch 120 to close, the solenoid coil 110 is energized to attract the valve member 106 into a state wherein the valve head portion of the valve member 106 sealingly contacts the top end of the cylindrical member 104. Thus, in this state, the direct fluid communication between the clean air side of the air filter 16 and the vacuum chamber 56 of the vacuum actuator 84 is shut off. Accordingly, the operation of the diaphragm member 54 and thus of the valve stem 88 are made only by the vacuum created at the port 33. Thus, in this instance, the upward and downward movements of the tapered valve head 90 of the valve stem 88 are made in proportion to the flow rate of the intake air passing through the air-fuel mixture passage without being affected by the atmospheric pressure, so that the clearance 91 between the tapered valve head 90 and the throat portion 80 of the through hole 78 is varied in proportion to the flow rate of the intake air. Now, as mentioned before, the throat portion 80 has been formed to allow the exhaust gases passing therethrough to have a constant sonic velocity. Therefore, the actual flow rate of the exhaust gases fed into the intake manifold 28 is proportional to the clearance 91 and accordingly the flow rate of the intake air, independently of the discrepancies in the pressures between the intake manifold 28 and the exhaust manifold 30. Even through the pressure gap between the intake manifold 28 and the exhaust manifold 30 becomes too small to provide the exhaust gases passing through the clearance 91 with the sonic velocity when the engine is subjected, under the above-stated circumstance, to a too high load operation, the characteristic performance and the running of the engine are not affected since the flow rate of the feeding exhaust gases is reduced preferably in this instance by closing of the throat 80.

On the contrary, when the transmission 66 is in its high speed range to cause the transmission switch 120 to open, the solenoid 110 is deenergized to allow the valve member 106 to open by the urging force of the compression spring 108. Therefore, in this instance, atmospheric air is introduced into the vacuum chamber 56 of the vacuum actuator 84 from the clean air side of the air filter 16 through the tubes 100 and 102 thereby allowing the diaphragm member 54 to return and stay in its normal position. Thus, the tapered valve head 90 of the valve stem 88 seals the throat 91 to stop the exhaust gas feed.

In summary, by the present invention, it is possible to regulate the flow rate of the exhaust gas feed into the intake manifold in such a manner that when the transmission is in its low and middle speed ranges, the flow rate of the feeding exhaust gases is proportional to the flow rate of the intake air passing through the air-fuel mixture passage, and when the transmission is in its high speed range, the feed of the exhaust gases is stopped. Accordingly, preferable reduction of nitrogen oxides is achieved without sacrificing the characteristic performance and fuel economy of the engine.

Although, in the previous description, only one preferred embodiment has been shown and described, the invention is not limited to the disclosed embodiment but is defined by the following claims.

What is claimed is:

1. An exhaust gas feed system for use with an internal combustion engine having a carburetor, a throttle valve rotatably disposed in an air-fuel mixture passage defined in said carburetor, an intake manifold for conveying the mixture to said engine, and an exhaust manifold for conveying the exhaust gases from said engine before discharging the same into the open air, said exhaust gas feed system comprising a first conduit fluidly connecting said exhaust manifold with said intake manifold for feeding a portion of exhaust gases in said exhaust manifold into said intake manifold; a restrictor disposed in said first conduit and having therein an opening operable to allow the exhaust gases passing therethrough to have a sonic velocity; valve means for varying the opening degree of said opening of said restrictor when actuated; pressure responsive means including a chamber fluidly connected through a second conduit with a port formed in said carburetor, and a movable member movable in response to vacuum supplied to said chamber, said port being located at a place where said port is positioned in the intake manifold side when the throttle valve is rotated at a predetermined angle from its closed position, said movable member carrying said valve means for actuating the same; a third conduit fluidly connecting said chamber of said pressure responsive means with the clean air side of an air filter; and magnetic valve means disposed in said third conduit and arranged to selectively close and open the passage of the same when electrically energized and de-energized.

2. An exhaust gas feed system as claimed in claim 1 further comprising a transmission switch arranged to close its circuit for energizing said magnetic valve, with power of an electric power source, when a transmission is in the predetermined speed range thereof.

3. An exhaust gas feed system as claimed in claim 2, in which said opening is formed into a conical shape to form a throat portion for allowing the exhauast gases passing through said opening to have the sonic velocity.

4. An exhaust gas feed system as claimed in claim 3, in which said valve means comprises a stem member connected at one end thereof to said movable member of said pressure responsive means for movement therewith, and a tapered valve head member connected to the other end of said stem for being reciprocally insertable into said opening of said restrictor in response to movements of said movable member.

* * * * *